US005445755A

United States Patent [19]

Convents et al.

[11] Patent Number: 5,445,755

[45] Date of Patent: Aug. 29, 1995

[54] DETERGENT COMPOSITIONS CONTAINING A PEROXIDASE/ACCELERATOR SYSTEM WITHOUT LINEAR ALKYLBENZENESULFONATE

[75] Inventors: Andre C. Convents, Diegem; Alfred Busch, Londerzeel; Isabelle M. C. De Groote, Strombeek-Bever, all of Belgium; Don K. K. Liu, Cincinnati, Ohio

[73] Assignee: The Procter & Gamble Company, Cincinnati, Ohio

[21] Appl. No.: 251,071

[22] Filed: May 31, 1994

[51] Int. Cl.[6] ..... C11D 3/28; C11D 3/395

[52] U.S. Cl. ..... 252/102; 252/550; 252/542; 252/174.12; 252/DIG. 12; 8/401

[58] Field of Search ..... 252/174.12, 542, 550, 252/102; 8/401, 111; 435/192

[56] References Cited

U.S. PATENT DOCUMENTS

| | | | |
|---|---|---|---|
| 3,654,179 | 4/1972 | Bauer | 8/401 |
| 4,077,768 | 3/1978 | Johnston et al. | 8/107 |
| 5,180,514 | 1/1993 | Farr et al. | 8/111 |
| 5,286,401 | 2/1994 | Dung et al. | 8/111 |
| 5,356,437 | 10/1994 | Pedersen et al. | 8/401 |
| 5,360,568 | 11/1994 | Madison et al. | 8/111 |

FOREIGN PATENT DOCUMENTS

| | | | |
|---|---|---|---|
| 0537381A1 | 10/1991 | European Pat. Off. | C11D 3/00 |
| 0538228A1 | 1/1992 | European Pat. Off. | C11D 3/00 |
| 211167 | 7/1982 | United Kingdom | D06L 3/02 |
| WO89/09813 | 10/1989 | WIPO | C11D 3/395 |

OTHER PUBLICATIONS

Application Ser. No. 08/251,057 liu et al May 31, 1994.
Application Ser. No. 08/105,222 Damhus et al Aug. 11, 1993.

*Primary Examiner*—Paul Lieberman
*Assistant Examiner*—Margaret Eismann
*Attorney, Agent, or Firm*—Michael D. Jones; Jerry J. Yetter; Jacobus C. Rasser

[57] ABSTRACT

Dye transfer inhibiting systems are disclosed, comprising an enzyme exhibiting peroxidase activity, a hydrogen peroxide source, an additional oxidizable substrate, and an accelerator preferably having the formula

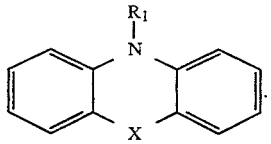

Detergent compositions free of linear alkylbenzenesulfonate containing the dye transfer inhibition system and typical detergent ingredients are also disclosed. More effective and efficient dye transfer inhibition of fugitive dyes is achieved by using the dye transfer inhibition system as a detergent additive or in a detergent composition matrix free of linear alkylbenzenesulfonate.

6 Claims, No Drawings

DETERGENT COMPOSITIONS CONTAINING A PEROXIDASE/ACCELERATOR SYSTEM WITHOUT LINEAR ALKYLBENZENESULFONATE

FIELD OF THE INVENTION

The present invention relates to a dye transfer inhibition system and detergent compositions containing a dye transfer inhibition system which inhibit the transfer of dye from a dyed fabric to another fabric during washing. The dye transfer inhibition system comprises a peroxidase enzyme, a hydrogen peroxide source, an oxidizable substrate, and an accelerator, preferably a phenothiazine accelerator, while the detergent composition is free of linear alkylbenzenesulfonate.

BACKGROUND OF THE INVENTION

One of the most persistent and troublesome problems arising during modern fabric laundering operations is the tendency of some colored fabrics to release dye ("fugitive dye") into the laundering solutions. The dye is then transferred onto other fabrics being washed therewith. Dye transfer occurs, to a greater or lesser extent, in most loads. It is not only a problem in the disastrous situation when the entire load turns pink or blue. It is present at low insidious levels virtually all the time, contributing to what is seen as dinginess on whites, dullness on colours or just cleaning. Dye transfer is also one of the users' most important concerns: a solution to the problem is one of their most often mentioned unmet needs.

One way of overcoming this problem would be to bleach the fugitive dyes washed out of dyed fabrics before they have the opportunity to become attached to other articles in the wash.

Suspended or solubilized dyes can to some degree be oxidized in solution by employing known bleaching agents.

GB 2 101 167 describes a stable liquid bleaching composition containing a hydrogen peroxide precursor which is activated to yield hydrogen peroxide on dilution.

However, it is important at the same time not to bleach the dyes actually remaining on the fabrics, that is, not to cause color damage.

U.S. Pat. No. 4,077,768 describes a process for inhibiting dye transfer by the use of an oxidizing bleaching agent together with catalytic compounds such as iron porphins.

U.S. patent application Ser. No. 421,414 describes peroxidases and oxidases utilized for the oxidation of organic or inorganic substances, including colored substances.

A dye transfer inhibiting composition comprising an enzymatic system capable of generating hydrogen peroxide and iron catalysts has been disclosed in copending EP Patent Application 91202655.6, filed Oct. 9, 1991.

EP 424 398-A describes a detergent additive capable of exerting a bleaching effect comprising a peroxidase. The additive further comprises one or more enzymes, particularly a lipase, protease, amylase or a cellulase.

Peroxidase is a bleaching enzyme which was proposed for dye transfer inhibition in detergent applications. The enzyme induces dye transfer inhibition via oxidation of bleeding dyes in solution. To achieve good dye bleaching an accelerator is required. Current peroxidase/accelerator technology systems only provide performance at pH levels below 8. This was a major limitation for the implementation of this technology in high pH detergents. An accelerator system based on phenothiazine 10-propionic acid was identified which allows the peroxidase to provide performance in high pH detergent: applications. It has now been surprisingly found that this system works exceptionally well in a formulation containing anionic surfactant, especially alkyl sulphate compositions without linear alkylbenzenesulfonate.

It is therefore an object of the present invention to provide dye transfer inhibition systems or detergent compositions containing such dye transfer inhibition system which exhibit optimum dye transfer inhibition in wash solutions by using said peroxidase in conjunction with a phenothiazine accelerator in the presence of anionic surfactant while the detergent composition is free of linear alkylbenzenesulfonate (LAS).

The anionic surfactant can be any sulfate or sulphonate based surfactant for detergent, like alkylsulfate. Preferred is an alkylsulfate containing an alkyl chain length between $C_8$–$C_{20}$. Alternative combinations are for instance ethoxylated alkyl sulfates in combination with alkyl sulfates. The ethoxylation degree is preferably from 1 to 50.

Addition of nonionic surfactant especially ethoxylated nonionic surfactants and/or fatty acid amide surfactants exhibits even a more pronounced dye transfer inhibition effect during the wash.

The nonionic surfactant consists of alkyl chains of C8–C20 and preferably ethoxylate groups with 1 to 50 monomer units. Also preferred is fatty amide surfactants like the $C_{10}$–$C_{18}$ N-alkyl polyhydroxy fatty acid amides. Typical examples include the C12–C18 N-methylglucamides (see WO 92/06154). Preferred levels of nonionic surfactants is 2–15% in finished product. According to another embodiment of this invention a process is also provided for laundering operations involving colored fabrics.

SUMMARY OF THE INVENTION

The present invention provides a detergent composition comprising an effective amount of:

a) an enzyme exhibiting peroxidase activity;

b) a hydrogen peroxide source selected from the group consisting of a hydrogen peroxide, hydrogen peroxide precursor, and an enzymatic system capable of generating hydrogen peroxide;

c) an accelerator system containing an organic chemical compound consisting of at least two aromatic rings of which aromatic rings at least one is substituted with one or more of the following atoms: nitrogen, oxygen and sulfur; and which aromatic rings may furthermore be fused rings and d) a surfactant system free of linear alkylbenzenesulfonate.

In a specific embodiment, the organic chemical compound may be described by the following formula:

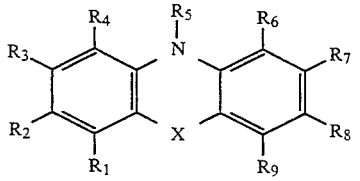

in which formula X represents one of the following groups: (—O—), (—S—), (—$NR^{15}$—), (—$CHR^{15}$—), (>C=O), (—CH=CH), (—CH=N—) and the substituent groups $R_1$–$R_9$ and $R^{15}$, which may be identical or different, independently represents any of the following radicals : hydrogen, halogen, hydroxy, formyl, carboxy and esters and salts hereof, carbamoyl, sulfo and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^{10}$; and which phenyl may furthermore be unsubstituted or substituted with one or more substituent groups $R^{10}$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^{10}$; which substituent group $R^{10}$ represents any of the following radicals: halogen, hydroxy, formyl, carboxy and esters and salts hereof, carbamoyl, sulfo and esters and salts hereof, sulfamoyl, nitro, amino, phenyl, aminoalkyl, piperidino, piperazinyl, pyrrolidino, $C_1$–$C_5$-alkyl, $C_1$–$C_5$-alkoxy; which carbamoyl, sulfamoyl and amino groups may furthermore be unsubstituted or substituted once or twice with hydroxy, $C_1$–$C_5$-alkyl, $C_1$–$C_5$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which general formula two of the substituent groups $R_1$–$R_8$ may together form a group —B—, in which B represents any of the following the groups : (—$CHR^{10}$—N=N—), (—CH=CH—)n, (—CH=N—)n or (—N=$CR^{10}$—NR11—), in which groups n represents an integer of from 1 to 3, $R^{10}$ is a substituent group as defined above and R11 is defined as $R^{10}$.

In particular embodiments, the organic chemical compound is 10-methylphenothiazine, 10-phenothiazine-propionic acid, N-hydroxysuccinimide-10-phenothiazinepropionate or 10-ethyl-4-phenothiazine-carboxylic acid, 10-ethylphenothiazine, 10 -propylphenothiazine, 10-isopropylphenothiazine, methyl-10-phenothiazinepropionate, 10-phenylphenothiazine, 10-allylphenothiazine, 10-(3-(4-methyl-1-piperazinyl)propyl)-phenothiazine, 10-(2-pyrrolidinoethyl)phenothiazine, chlorpromazine, 2-chloro-10-methylphenothiazine, 2-acetyl-10-methylphenothiazine, 4-carboxy-10-phenothiazine, 10-methylphenoxazine, 10-ethylphenoxazine, 10-phenoxazine-propionic acid or 4-carboxy-10-phenoxazine-propionic acid.

In a more preferred embodiment, the present invention provides a detergent composition free of linear alkylbenzenesulfonate comprising an effective amount of: an enzyme exhibiting peroxidase activity; a hydrogen peroxide source selected from the group consisting of hydrogen peroxide, a hydrogen peroxide precursor and an enzymatic system capable of generating hydrogen peroxide; and a phenothiazine accelerator having the formula:

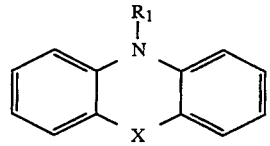

wherein X is S or O, and $R_1$ is —$CH_3$, —$CH_2CH_3$, —$CH_2CH_2CH_2NH_2$, or —$CH_2CH_2COOH$.

In another aspect, the present invention encompasses detergent compositions comprising the dye transfer inhibition system set forth above together with typical detergent ingredients including a detergent surfactant, detergent builder and other detergent adjuncts.

DETAILED DESCRIPTION OF THE INVENTION

The dye transfer inhibition systems herein contain an enzyme exhibiting peroxidase activity, a hydrogen peroxide source, an additional oxidizable substrate, and an accelerator as essential ingredients.

PEROXIDASES

The peroxidases which may be employed in the dye transfer inhibition systems and detergent compositions of the present invention may be isolated from and are producible by plants (e.g. horseradish peroxidase) or microorganisms such as fungi or bacteria. Some preferred fungi include strains belonging to the subdivision Deuteromycotina, class Hyphomycetes, e.g. Fusarium, Humicola, Tricoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucana* (IFO 6113), *Verticilluum alboatrum, Verticillum dahlie, Arthromyces ramosus* (FERM P-7754), *Caldariomyces fumago, Ulocladium chartarum, Embellisia allior Dreschlera halodes.*

Other preferred fungi include strains belonging to the subdivision Basidiomycotina, class Basidiomycetes, e.g. Coprinus, Phanerochaete, Coriolus or Trametes, in particular *Coprinus cinereus* f. *microsporus* (IFO 8371), *Coprinus macrorhizus, Phanerochaete chrysosporium* (e.g. NA-12) or *Coriolus versicolor* (e.g. PR4 28-A).

Further preferred fungi include strains belonging to the subdivision Zygomycotina, class Mycoraceae, e.g. Rhizopus or Mucor, in particular *Mucor hiemalis.*

Some preferred bacteria include strains of the order Actinomycetales, e.g. *Streptomyces spheroides* (ATTC 23965), *Streptomyces thermoviolaceus* (IFO 12382) or *Streptoverticillum verticillium* ssp. *verticillium.*

Other preferred bacteria inlude *Bacillus pumillus* (ATCC 12905), *Bacillus stearothermophilus, Rhododbacter sphaeroides, Rhodomonas palustri, Streptococcus lactis, Pseudomonas purrocinia* (ATCC 15958 ) or *Pseudomonas fluorescens* (NRRL B-11).

Other potential sources of useful peroxidases are listed in B.C. Saunders et al., op. cit., pp. 41–43.

Methods of producing enzymes to be used according to the invention are described in the art, cf. for example *FEBS Letters* 1625, 173(1), *Applied and Environmental Microbiology*, Feb. 1985, pp. 273–278, *Applied Microbiol. Biotechnol.* 26, 1987, pp. 158–163, *Biotechnology Letters* 9(5), 1987, pp. 357–360, *Nature* 326, 2 Apr. 1987, *FEBS*

*Letters* 4270, 209(2), p. 321, EP 179 486, EP 200 565, GB 2 167 421, EP 171 074, and *Agric. Biol. Chem.* 50(1), 1986, p. 247.

In general, enzymes exhibiting peroxidase activity which are useful in the dye transfer inhibition system of the present invention are set forth in U.S. Pat. No. 5,273,896 (Pedersen et al), issued Dec. 28, 1993, incorporated herein by reference.

Particularly preferred peroxidases are those which are active at the typical pH of washing liquors, i.e. at a pH of 6.5–10.5, preferably 7–10.5, and most preferably 7.5–10.5. Such enzymes may be isolated by screening for the relevant enzyme production by alkalophilic microorganisms, e.g. using the ABTS assay described in R. E. Childs and W. G. Bardsley, *Biochem. J.* 145, 1975, pp. 93–103.

Other preferred peroxidases are those which exhibit a good thermostability as well as a good stability towards commonly used detergent components such as non-ionic, cationic, or anionic surfactants, detergent builders, phosphate etc.

Another group of useful peroxidases are haloperoxidases, such as chloro- and bromoperoxidases, lignineperoxidase and Manganese dependent peroxidase.

The peroxidase-enzyme may furthermore be one which is producible by a method comprising cultivating a host cell transformed with a recombinant DNA vector which carries a DNA sequence encoding said enzyme as well as DNA sequences encoding functions permitting the expression of the DNA sequence encoding the enzyme, in a culture medium under conditions permitting the expression of the enzyme and recovering the enzyme from the culture.

A DNA fragment encoding the enzyme may, for instance, be isolated by establishing a cDNA or genomic library of a microorganism producing the enzyme of interest, such as one of the organisms mentioned above, and screening for positive clones by conventional procedures such as by hybridization to oligonucleotide probes synthesized on the basis of the full or partial amino acid sequence of the enzyme, or by selecting for clones expressing the appropriate enzyme activity, or by selecting for clones producing a protein which is reactive with an antibody against the native enzyme.

Once selected, the DNA sequence may be inserted into a suitable replicable expression vector comprising appropriate promotors, operator and terminator sequences permitting the enzyme to be expressed in a particular host organism, as well as an origin of replication, enabling the vector to replicate in the host organism in question.

The resulting expression vector may then be transformed into a suitable host cell, such as a fungal cell, preferred examples of which are a species of Aspergillus, most preferably *Aspergillus oryzae* or *Aspergillus niger*. Fungal cells may be transformed by a process involving protoplast formation and transformation of the protoplasts followed by regeneration of the cell wall in a manner known per se. The use of Aspergillus as a host microorganism is described in EP 238,023 (of Novo Industri A/S), the contents of which are hereby incorporated by reference.

Alternatively, the host organisms may be a bacterium, in particular strains of Streptomyces and Bacillus, or *E. coli*. The transformation of bacterial cells may be performed according to conventional methods, e.g. as described in T. Maniatis et al., *Molecular Cloning : A Laboratory Manual*, Cold Spring Harbor, 1982.

The screening of appropriate DNA sequences and construction of vectors may also be carried out by standard procedures, cf. T. Maniatis et al., op. cit.

The medium used to cultivate the transformed host cells may be any conventional medium suitable for growing the host cells in question. The expressed enzyme may conveniently be secreted into the culture medium and may be recovered therefrom by well-known procedures including separating the cells from the medium by centrifugation or filtration, precipitating proteinaceous components of the medium by means of a salt such as ammonium sulphate, followed by chromatographic procedures such as ion exchange chromatography, affinity chromatography, or the like.

The screening of appropriate DNA sequences and construction of vectors may also be carried out by standard procedures, cf. T. Maniatis et al., o.p. cit.

The medium used to cultivate the transformed host cells may be any conventional medium suitable for growing the host cells in question. The expressed enzyme may conveniently be secreted into the culture medium and may be recovered therefrom by well-known procedures including separating the cells from the medium by centrifugation or filtration, precipitating proteinaceous components of the medium by means of a salt such as ammonium sulphate, followed by chromatographic procedures such as ion exchange chromatography, affinity chromatography, or the like.

At the beginning or during the process, $H_2O_2$ may be added, e.g. in an amount of 0.001–5 mM, particularly 0.01–1 mM. When using Coprinus peroxidase, 0.01–0.25 mM $H_2O_2$ is preferred, and with *B. pumilus* peroxidase 0.1–1 mM $H_2O_2$.

The hydrogen peroxide may be added as hydrogen peroxide or a precursor thereof, preferably a perborate or percarbonate. The level of hydrogen peroxide precursor that can be used is dependent on the specific properties of the peroxidase chosen, e.g. Coprinus peroxidase should be applied in a detergent composition which contains less than 5% perborate.

In the process of this invention, it may be desirable to utilize an enzymatic process for hydrogen peroxide formation. Thus, the process according to the invention may additionally comprise adding an enzymatic system (i.e. an enzyme and a substrate therefor) which is capable of generating hydrogen peroxide at the beginning or during the washing and/or rinsing process.

One such category of hydrogen peroxide generating systems comprises enzymes which are able to convert molecular oxygen and an organic or inorganic substrate into hydrogen peroxide and the oxidized substrate respectively. These enzymes produce only low levels of hydrogen peroxide, but they may be employed to great advantage in the process of the invention as the presence of peroxidase ensures an efficient utilization of the hydrogen peroxide produced.

Preferred hydrogen peroxide-generating enzymes are those which act on cheap and readily available substrates which may conveniently be included into detergent compositions. An example of such a substrate is glucose which may be utilized for hydrogen peroxide production by means of glucose oxidase. Suitable oxidases include those which act on aromatic compounds such as phenols and related substances, e.g. catechol oxidases, laccase. Other suitable oxidases are urate oxidase, galactose oxidase, alcohol oxidases, amine oxidases, amino acid oxidase, amyloglucosidase, and cholesterol oxidase.

The preferred enzymatic systems are alcohol and aldehyde oxidases.

The more preferred systems for granular detergent application would have solid alcohols, e.g. glucose whose oxidation is catalysed by glucose oxidase to glucoronic acid with the formation of hydrogen peroxide.

The more preferred systems for liquid detergent application would involve liquid alcohols which could also act as, for example, solvents. An example is ethanol/ethanol oxidase.

The quantity of oxidase to be employed in compositions according to the invention should be at least sufficient to provide a constant generation of 0.01 to 10 ppm AvO per minute in the wash. For example, with the glucose oxidase, this can be achieved at room temperature and at pH 6 to 11, preferentially 7 to 9 with 50–5000 U/l glucose oxidase, 0.005 to 0.5 % glucose under constant aeration.

The addition of another oxidisable substrate for the peroxidase at the beginning or during the washing and/or rinsing process may enhance the dye transfer inhibitory effect of the peroxidase employed. This is thought to be ascribable to the formation of short-lived radicals or other oxidized states of this substrate which participate in the bleaching or other modification of the colored substance. Examples of such oxidisable substrates are metal ions, e.g. $Mn^{++}$, halide ions, e g chloride or bromide ions, or organic compounds such as phenols, e.g. p-hydroxycinnamic acid or 2,4-dichlorophenol. Other examples of phenolic compounds which may be used for the present purpose are those given in M. Kato and S. Shimizu, *Plant Cell Physiol.* 26(7), 1985, pp. 1291–1301 (cf. Table 1 in particular) or B.C. Saunders et al., op. cit., p. 141 ff. The amount of oxidisable substrate to be added is suitably between about 1 uM and 1 mM.

In the process of the invention, the peroxidase will typically be added as a component of a detergent composition and may be added in an amount of 0.01–100 mg enzyme per liter of wash liquid, preferably in an amount of 0.04–0.2 mg enzyme per liter. As such, it may be included in the detergent composition in the form of a non-dusting granulate, a liquid, in particular a stabilized liquid, or a protected enzyme. Non-dusting granulates may be produced, e.g. as disclosed in U.S. Pat. Nos. 4,106,991 and 4,661,452 (both to Novo Industri A/S) and may optionally be coated by methods known in the art. Liquid enzyme preparations may, for instance, be stabilized by adding a polyol such as propylene glycol, a sugar or sugar alcohol, lactic acid or boric acid according to established methods. Other enzyme stabilizers are well known in the art. Protected enzymes may be prepared according to the method disclosed in EP 238,216. The detergent composition may also comprise one or more substrates for the peroxidase. Usually, the pH of a solution of the detergent composition of the invention will be preferably from 7–12, especially from 7.5 to 9.5. The wash pH is dependent on the peroxidase chosen, e.g. Coprinus peroxidase should be applied in a wash pH below 9.5.

ACCELERATORS

The present invention relates to the use of chemical compounds for enhancing the activity of peroxidase enzymes or peroxidase acting compounds. Accordingly, the invention provides an agent capable of enhancing the effect of a peroxidase enzyme or a peroxidase acting compound, in the following accelerator (hereinafter also referred to as enhancing agent).

Contrary to the accelerators known and previously described, the accelerators of this invention are capable of acting at alkaline conditions, i.e., at pH levels above about 8 . This feature allows the accelerators of the invention to be implemented into various processes including laundering of fabrics.

Basically, the accelerator is an organic chemical compound consisting of at least two aromatic rings of which aromatic rings at least one is substituted with one or more of the following atoms: nitrogen, oxygen and sulfur; and which aromatic rings may furthermore be fused rings.

In a more preferred embodiment, the enhancing agent of the invention is an organic chemical compound of the general formula I:

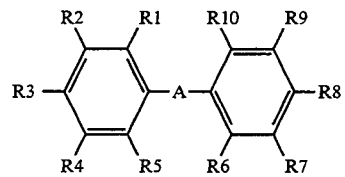

in which general formula A represents a single bond, or one of the following groups: $(—CR^{11}=CR^{15}—)_n$, $(—NR^{11}—)$, $(—CR^{11}=N—)_n$, $(—NR^{11}—CR^{12}=N—N=CR^{13}—NR^{15}—)$, $(—NR^{11}—CR^{12}=N=CR^{15}—)$, $(—NR^{11}—CR^{12}=N—)_n$, $(—CR^{12}=N—NR^{11}—)$, $(—NR^{11}—CR^{12}=CR^{13}—)$, $(—N=N—)$, in which groups n represents an integer of from 1 to 6; or A represents carbon, carbonyl, nitrogen, sulfur, oxygen, selenium, or phosphor, which carbon, phosphor and nitrogen may be unsubstituted or substituted with a substituent group $R^{11}$;

and in which general formula the substituent groups $R^{1-R13}$ and $R^{15}$, which may be identical or different independently represents any of the following radicals: hydrogen, halogen, hydroxy, formyl, carboxy and esters and salts hereof, carbamoyl, sulfo and esters and salts hereof, sulfamoyl, phospho, phosphono, phosphonooxy, sulfandiyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^{14}$; and which phenyl may furthermore be unsubstituted or substituted with one or more substituent groups $R^{14}$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^{14}$;

which substituent group $R^{14}$ represents any of the following radicals: halogen, hydroxy, formyl, carboxy and esters and salts hereof, carbamoyl, sulfo and esters and salts hereof, sulfamoyl, nitro, amino, phenyl, aminoalkyl, piperidino, piperazinyl, pyrrolidino, $C_1$–$C_5$-alkyl, $C_1$–$C_5$-alkoxy; which carbamoyl, sulfamoyl, and amino groups may furthermore be unsubstituted or substituted once: or twice with hydroxy, $C_1$–$C_5$-alkyl, $C_1$–$C_5$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which general formula $R^5$ and $R^6$ may together form a group —B—, in which B represents a single bond, the group $(—CH=CH—)_n$, or the group $(—CH=N—)_n$, in which groups n represents an integer of from 1 to 6; or B represents carbon, nitrogen, sulfur, oxygen, selenium, or tellurium, which carbon and nitrogen may be unsubstituted or substituted with a substituent group $R^{14}$ as defined above;

or in which general formula two of the substituent groups $R^1$–$R^{10}$ may together form a group —C—, in which C represents any of the following groups: $(—CHR^{11}—N=N—)$, $(—CH=CH—)_n$, $(—CH=N—)_n$, in which groups n represents an integer of from 2 to 4, and in which groups $R^{11}$ is a substituent group as defined above;

or in which general formula $R^5$ and $R^{12}$, and/or $R^6$ and $R^{13}$, when n in the above formula being 1, may together form a group —D—, in which D represents the groups: $(—CHR^{11}—)$, $(—NR^{11}—)$, $(—CR^{11}=CR^{15}—)$, $(—CR^{11}=N—)$, $(—N=CR^{11}—)$, (—O—), (>C=O) (—S—), and in which groups $R^{11}$ and $R^{15}$ are substituent groups as defined above.

In particular embodiments, the enhancing agent is 2,2'-azino-bis(3-ethylbenzothiazoline-6-sulfonate), 6-amino-3-methyl-2-benzothiazolinone azine with 3-methyl-2-benzothiazolinone, 2-(p-aminophenyl) -6-methylbenzothiazole-7-sulfonic acid, N-(4-(dimethylamino)benzylidene)-p-anisidine, 3-methyl-2-benzothiazolinone(4-(dimethylamino)benzylidene)-hydrazone.

In another preferred embodiment, the enhancing agent of the invention is an organic chemical compound of the general formula II:

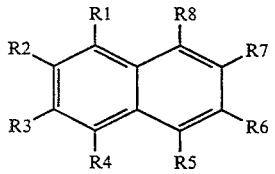

in which the substituent groups $R^1$–$R^8$, which may be identical or different, independently represents any of the following radicals: hydrogen, halogen, hydroxy, formyl, carboxy and esters and salts hereof, carbamoyl, sulfo and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^9$; and which phenyl may furthermore be unsubstituted or substituted with one or more substituent groups $R^9$; and which $C_1$–$C_{14}$-alkyl, $C_1$–$C_5$-alkoxy, carbonyl-$C_5$–$C_5$-alkyl, and aryl-$C_1$–$C_5$-alkyl groups may be saturated or unsaturated, branched or unbranched, and may furthermore be unsubstituted or substituted with one or more substituent groups $R^9$;

which substituent group $R^9$ represents any of the following radicals: halogen, hydroxy, formyl, carboxy and esters and salts hereof, carbamoyl, sulfo and esters and salts hereof, sulfamoyl, nitro, amino, phenyl, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_3$-alkyl, $C_1$–$C_3$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which general formula two of the substituent groups $R^1$–$R^8$ may together form a group —B—, in which B represents any of the following groups: (—N=N—), $(—CH=CH—)_n$, $(—CH=N—)_n$, $(—N=CR^9—NR^{10}—)$ or $(—N=N—CR^9—)$, in which groups n represents an integer of from 1 to 3, $R^9$ is a substituent group as defined above and $R^{10}$ is defined as $R^9$.

In a more specific embodiment, the enhancing agent of the invention is an organic chemical compound of the following formula:

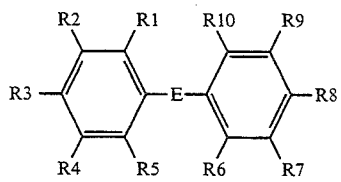

in which formula E represents a single bond, a carbonyl group or one of the following groups: $(—CH=CH—)_n$, $(—CH=N—)_n$ or $(—NR^{11}—)$, in which n represents an integer from 1 to 2. The substituents groups $R^1$–$R^{11}$ may be identical or different, independently being one of the following radicals: hydrogen, halogen, hydroxy, formyl, carboxy and esters and salts hereof, carbamoyl, sulfo and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^{14}$; and which phenyl may furthermore be unsubstituted or substituted with one or more substituent groups $R^{14}$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^{14}$;

which substituent group $R^{14}$ represents any of the following radicals: halogen, hydroxy, formyl, carboxy and esters and salts hereof, carbamoyl, sulfo and esters and salts hereof, sulfamoyl, nitro, amino, phenyl, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_3$-alkyl, $C_1$–$C_3$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which specific formula two of the substituent groups $R^5$ and $R^6$ may together form a group —B—, in which B represents the groups: $(—CH=N—)_n$, (—CH=CH—) or $(—CHR^{14}—)$ in which groups n represents an integer of from 1 to 2 and $R^{14}$ is a substituent group as defined above.

In particular embodiments, the enhancing agent is 4-amino-4′-methoxystilbene, 4,4′-diaminostilbene-2,2′-disulfonic acid, iminostilbene, 4,4′-dihydroxybenzophenone, N-benzylidene-4-biphenylamine, 4,4′-diaminodiphenylamine, 4,4′-diaminodiphenylaminesulfate, 2,7-diaminofluorene, triphenylamine.

In another specific embodiment, the enhancing agent may be described by the following formula:

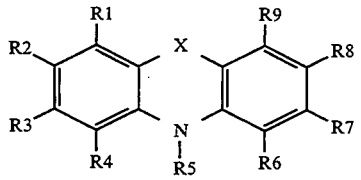

in which formula X represents one of the following groups: (—O—), (—S—), $(—NR^{15}—)$, $(—CHR^{15}—)$, (>C=O), (—CH=CH—), (—CH=N—) and the substituent groups $R^1$–$R^9$ and $R^{15}$, which may be identical or different, independently represents any of the following radicals: hydrogen, halogen, hydroxy, formyl, carboxy and esters and salts hereof, carbamoyl, sulfo and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^{10}$; and which phenyl may furthermore be unsubstituted or substituted with one or more substituent groups $R^{10}$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^{10}$;

which substituent group $R^{10}$ represents any of the following radicals: halogen, hydroxy, formyl, carboxy and esters and salts hereof, carbamoyl, sulfo and esters and salts hereof, sulfamoyl, nitro, amino, phenyl, aminoalkyl, piperidino, piperazinyl, pyrrolidino, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_5$-alkyl, $C_1$–$C_5$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which general formula two of the substituent groups $R^1$–$R^8$ may together form a group —B—, in which B represents any of the following the groups: $(—CHR^{10}—N=N—)$, $(—CH=CH—)_n$, $(—CH=N—)_n$ or $(—N=CR^{10}—NR^{11}—)$, in which groups n represents an integer of from 1 to 3, $R^{10}$ is a substituent group as defined above and $R^{11}$ is defined as $R^{10}$.

In particular embodiments, the enhancing agent is 10-methylphenothiazine, 10-phenothiazine-propionic acid, N-hydroxysuccinimide-10-phenothiazine-propionate or 10-ethyl-4-phenothiazine-carboxylic acid, 10-ethylphenothiazine, 10-propylphenothiazine, 10-isopropylphenothiazine, methyl 10-phenothiazinepropionate, 10-phenylphenothiazine, 10-allylphenothiazine, 10-(3-(4-methyl-1-piperazinyl)propyl)phenothiazine, 10-(2-pyrrolidinoethyl)phenothiazine, chlorpromazine, 2-chloro-10-methylphenothiazine, 2-acetyl-10-methylphenothiazine, 4-carboxy-10-phenothiazine, 10-methylphenoxazine, 10-ethylphenoxazine, 10-phenoxazine-propionic acid or 4-carboxy-10-phenoxazine-propionic acid.

In another specific embodiment, enhancing agent is a biphenyl derivative of the following formula:

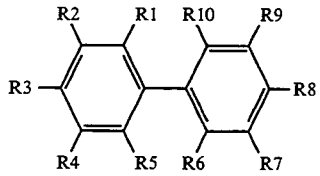

in which the substituent groups $R^1$–$R^{10}$, which may be identical or different, independently represents any of the following radicals: hydrogen, halogen, hydroxy, formyl, carboxy and esters and salts hereof, carbamoyl, sulfo and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted substituted once or twice with a substituent group $R^{11}$; and which phenyl may furthermore be unsubstituted or substituted with one or more substituent groups $R^{11}$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^{11}$;

which substituent group $R^{11}$ represents any of the following radicals: halogen, hydroxy, formyl, carboxy and esters and salts hereof, carbamoyl, sulfo and esters and salts hereof, sulfamoyl, nitro, amino, phenyl, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_3$-alkyl, $C_1$–$C_3$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl.

In particular embodiments, the enhancing agent is benzidine, 3,3'-dimethylbenzidine, 3,3'-dimethoxybenzidine, 3,3', 5 5'-tetramethylbenzidine, 4'-hydroxy-4-biphenylcarboxylic acid, or 4,4'-dihydroxybiphenylene.

In another specific embodiment, the enhancing agent is a naphthalene derivative of the following formula:

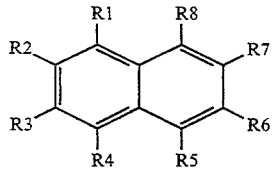

in which the substituent groups $R^1$–$R^8$, which may be identical or different, independently represents any of the following radicals: hydrogen, halogen, hydroxy, formyl, carboxy and esters and salts hereof, carbamoyl, sulfo and esters and salts hereof, sulfamoyl, nitro, amino, phenyl, $C_{1-C14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^9$; and which phenyl may furthermore be unsubstituted or substituted with one or more substituent groups $R^9$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^9$;

which substituent group $R^9$ represents any of the following radicals: halogen, hydroxy, formyl, carboxy and esters and salts hereof, carbamoyl, sulfo and esters and salts hereof, sulfamoyl, nitro, amino, phenyl, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_3$-alkyl, $C_1$–$C_3$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which general formula two of the substituent groups $R^1$–$R^8$ may together form a group —B—, in which B represents any of the following groups: (—N=N—), $(—CH=CH—)_n$, $(—CH=N—)_n$, $(—N=CR^9—NR^{10}—)$ or $(—N=N—CR^9—)$, in which groups n represents an integer of from 1 to 3, $R^9$ is a substituent group as defined above and $R^{10}$ is defined as $R^9$.

In particular embodiments, the enhancing agent is 6hydroxy-2-naphtoic acid, 6-bromo-2-naphtol, 7-methoxy-2-naphtol, 7-amino-2-naphthalene sulfonic acid, 5-amino-2-naphthalene sulfonic acid, 1,5-diaminonaphthalene, 7-hydroxy-1,2-naphthimidazole, 5-amino-2-naphthalenesulfonic acid, 1,6-dibromo-2-naphtol or 7-methoxy-2-naphtol.

The enhancing agent of the invention may be in free form or in the form of an addition salt. The accelerator of the invention may be in free form or in the form of an addition salt.

In a preferred embodiment, the dye transfer inhibition systems and detergent compositions of the invention herein contain a phenothiazine or phenoxazine accelerator of the formula:

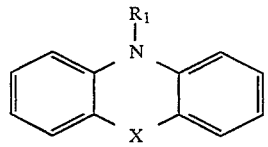

wherein X is S or O and $R_1$ is $—CH_3$, $—CH_2CH_3$, $—CH_2CH_2CH_2NH_2$, or $—CH_2CH_2COOH$. Preferred of the above accelerators is 10-phenothiazineproprionic acid, i.e., wherein R is $CH_2CH_2COOH$. The accelerator is present at a level of from about 0.1 $\mu$M to about 500 $\mu$M, preferably from about 1 $\mu$M to about 30 $\mu$M.

The phenothiazine accelerators are synthesized from 10-H-phenothiazine and are commercially available from Aldrich Chemicals.

As compared to other dye transfer inhibition systems, the peroxidase-phenothiazine accelerator dye transfer inhibition system provide greater efficiencies with respect to bleaching fugitive dyes in wash water solutions. The dye transfer inhibition systems of the invention hereof provide good dye transfer inhibition performance with, e.g., about 50 to 75% less peroxidase when compared to the dye transfer inhibition performance of similar systems which lack the phenothiazine accelerator.

Naturally occurring peroxidase enzymes typically show low activity against most common substrates at pH above about 9. Thus, peroxidase-based dye transfer inhibition (DTI) systems are ineffective in most detergent matrices where pH levels can range from about 9.5 to 10.5 and as high as about pH 11. The phenothiazine accelerators of the invention herein have been identified as efficient peroxidase accelerators even at pH levels above about 10. This allows for the formulation of DTI systems which are effective at high pH levels and which contain naturally occurring peroxidases and nature-identical peroxidases produced by genetic engineering.

DETERGENT ADJUNCTS

The present invention also pertains to detergent compositions which contain the dye transfer inhibition system herein and typical detergent components in the usual amounts, with the proviso that the detergent compositions are free of linear alkylbenzenesulfonate. Thus, organic surfactants anionic, nonionic, ampholytic, or zwitterionic or less usually cationic and mixtures thereof, may be present. Suitable surfactants are well known in the art and an extensive list of such compounds is given in U.S. Pat. No. 3,717,630 and in U.S.

patent application Ser. No. 589,116. The anionic surfactant can be any sulphate or sulphonate based surfactant for detergent application, like alkyl sulphate. However also oleoyl sarcosinate can be employed as the anionic detersive surfactant in the present invention. Oleoyl sarcosinate is for instance described in U.S. Pat. No. 2,542,385. Preferred is an alkyl sulphate containing an alkyl chain length between $C_8$–$C_{20}$. Alternative combinations are for instance ethoxylated alkyl sulfates in combination with alkyl sulfates. The ethoxylation degree is preferably from 1 to 50.

Detergent compositions useful in the present invention contain from 1 to 95%, preferable from 5 to 40% of a nonionic, anionic, zwitterionic, or mixtures thereof.

SURFACTANT SMSTE

The detergent compositions according to the present invention comprise a surfactant system wherein the surfactant can be selected from nonionic and/or anionic and/or cationic and/or ampholytic and/or zwitterionic and/or semi-polar surfactants.

Preferred non-alkylbenzene sulfonate surfactant systems to be used according to the present invention comprise as a surfactant one or more of the nonionic and/or anionic surfactants described herein.

Polyethylene, polypropylene, and polybutylene oxide condensates of alkyl phenols are! suitable for use as the nonionic surfactant of the surfactant systems of the present invention, with the polyethylene oxide condensates being preferred. These compounds include the condensation products of alkyl phenols having an alkyl group containing from about 6 to about 14 carbon atoms, preferably from about 8 to about 14 carbon atoms, in either a straight-chain or branched-chain configuration with the alkylene oxide. In a preferred embodiment, the ethylene oxide is present in an amount equal to from about 2 to about 25 moles, more preferably from about 3 to about 15 moles, of ethylene oxide per mole of alkyl phenol. Commercially available nonionic surfactants of this type include Igepal TM CO-630, marketed by the GAF Corporation; and Triton TM X-45, X-114, X-100 and X-102, all marketed by the Rohm & Haas Company. These surfactants are commonly referred to as alkylphenol alkoxylates (e.g., alkyl phenol ethoxylates).

The condensation products of primary and secondary aliphatic alcohols with from about 1 to about 25 moles of ethylene oxide are suitable for use as the nonionic surfactant of the nonionic surfactant systems of the present invention. The alkyl chain of the aliphatic alcohol can either be straight or branched, primary or secondary, and generally contains from about 8 to about 22 carbon atoms. Preferred are the condensation products of alcohols having an alkyl group containing from about 8 to about 20 carbon atoms, more preferably from about 10 to about 18 carbon atoms, with from about 2 to about 10 moles of ethylene oxide per mole of alcohol. Examples of commercially available nonionic surfactants of this type include Tergitol TM 15-S-9 (the condensation product of $C_{11}$–$C_{15}$ linear alcohol with 9 moles ethylene oxide), Tergitol TM 24-L-6 NMW (the condensation product of $C_{12}$–$C_{14}$ primary alcohol with 6 moles ethylene oxide with a narrow molecular weight distribution), both marketed by Union Carbide Corporation; Neodol TM 45-9 (the condensation product of $C_{14}$–$C_{15}$ linear alcohol with 9 moles of ethylene oxide), Neodol TM 23-6.5 (the condensation product of $C_{12}$–$C_{13}$ linear alcohol with 6.5 moles of ethylene oxide), Neodol TM 45-7 (the condensation product of $C_{14}$–$C_{15}$ linear alcohol with 7 moles of ethylene oxide), Neodol TM 45-4 (the condensation product of $C_{14}$–$C_{15}$ linear alcohol with 4 moles of ethylene oxide) marketed by Shell Chemical Company, and Kyro TM EOB (the condensation product of $C_{13}$–$C_{15}$ alcohol with 9 moles ethylene oxide), marketed by The Procter & Gamble Company.

Also useful as the nonionic surfactant of the surfactant systems of the present invention are the alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g. a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6-positions on the preceding saccharide units. The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position) . The additional glycosyl units can then be attached between their 1-position and the preceding glycosyl units 2-, 3-, 4- and/or 6-position, preferably predominately the 2-position.

Other suitable nonionic surfactants are the condensation products of ethylene oxide with a hydrophobic base formed by the condensation of propylene oxide with propylene glycol are also suitable for use as the additional nonionic surfactant of the nonionic surfactant systems of the present invention. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic TM surfactants, marketed by BASF.

Also suitable for use as the nonionic surfactant of the nonionic surfactant system of the present invention, are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic TM compounds, marketed by BASF.

Preferred for use as the nonionic surfactant of the surfactant systems of the present invention are polyethylene oxide condensates of alkyl phenols condensation products of primary and secondary aliphatic alcohols with from about 1 to about 25 moles of ethylene oxide, alkylpolysaccharides, and mixtures thereof. Most preferred are $C_8$–$C_{14}$ alkyl phenol ethoxylates having from 3 to 15 ethoxy groups and $C_8$–$C_{18}$ alcohol ethoxylates (preferably $C_{10}$ avg.) having from 2 to 10 ethoxy groups, and mixtures thereof.

Highly preferred nonionic surfactants are polyhydoxy fatty acid amide surfactants of the formula.

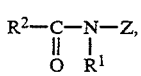

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

When included in such laundry detergent compositions, the nonionic surfactant systems of the present invention act to improve the greasy/oily stain removal properties of such laundry detergent compositions across a broad range of laundry conditions.

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{20}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethyl-ammonium cations and quaternary ammonium cations such as tetramethylammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}E(1.0)M$), $C_{12}$–$C_{18}$ alkyl polyethoxylate (2.25) sulfate ($C_{12}$–$C_{18}E(2.25)M$), $C_{12}$–$C_{18}$ alkyl polyethoxylate (3.0) sulfate ($C_{12}$–$C_{18}E(3.0)M$), and $C_{12}$–$C_{18}$ alkyl polyethoxylate (4.0) sulfate ($C_{12}$–$C_{18}E(4.0)M$), wherein M is conveniently selected from sodium and potassium.

When included therein, the laundry detergent compositions of the present invention typically comprise from about 1% to about 40%, preferably from about 3% to about 20% by weight of such anionic surfactants.

The laundry detergent compositions of the present invention may also contain cationic, ampholytic, zwitterionic, and semi-polar surfactants, as well as the nonionic and/or anionic surfactants other than those already described herein. Preferred cationic surfactant systems include nonionic and ampholytic surfactants.

Cationic detersive surfactants suitable for use in the laundry detergent compositions of the present invention are those having one long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$is selected from the group consisting of $-CH_2CH_2-$, $-CH_2CH(CH_3)-$, $-CH_2CH(CH_2OH)-$, $-CH_2CH_2CH_2-$, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, $-CH_2CHOH-CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Highly preferred cationic surfactants are the water-soluble quaternary ammonium compounds useful in the present composition having the formula:

$$R_1R_2R_3R_4N^+X^- \quad (i)$$

wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and $-(C_2H_{40})_xH$ where x has a value from 2 to 5, and X is an anion. Not more than one of $R_2$, $R_3$ or $R_4$ should be benzyl.

The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and hydroxyethyl groups and the anion X may be selected from halide, methosulphate, acetate and phosphate ions.

Examples of suitable quaternary ammonium compounds of formulae (i) for use herein are:

- coconut trimethyl ammonium chloride or bromide;
- coconut methyl dihydroxyethyl ammonium chloride or bromide;
- decyl triethyl ammonium chloride;
- decyl dimethyl hydroxyethyl ammonium chloride or bromide;
- $C_{12-15}$ dimethyl hydroxyethyl ammonium chloride or bromide;
- coconut dimethyl hydroxyethyl ammonium chloride or bromide;
- myristyl trimethyl ammonium methyl sulphate;

lauryl dimethyl benzyl ammonium chloride or bromide;

lauryl dimethyl (ethenoxy)$_4$ ammonium chloride or bromide;

choline esters (compounds of formula (i) wherein $R_1$ is $$-CH_2-O-\underset{\underset{O}{\|}}{C}-C_{12-14}$$

alkyl and $R_2R_3R_4$ are methyl).

di-alkyl imidazolines [compounds of formula (i)].

Other cationic surfactants useful herein are also described in U.S. Pat. No. 4,228,044, Cambre, issued Oct. 14, 1980.

When included therein, the laundry detergent compositions of the present invention typically comprise from 0% to about 25%, preferably from about 3% to about 15% by weight of such cationic surfactants.

Ampholytic surfactants are also suitable for use in the laundry detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 to Laughlin et al., issued Dec. 30, 1975 at column 19, lines 18–35, for examples of ampholytic surfactants.

When included therein, the laundry detergent compositions of the present invention typically comprise from 0% to about 15%, preferably from about 1% to about 10% by weight of such ampholytic surfactants.

Zwitterionic surfactants are also suitable for use in laundry detergent compositions. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants.

When included therein, the laundry detergent compositions of the present invention typically comprise from 0% to about 15%, preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula $$R^3(OR^4)_xN(\overset{\overset{O}{\|}}{R^5})_2$$

wherein $R^3$ is an alkyl, hydroxyalkyl, or alkyl phenyl group or mixtures therof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

When included therein, the laundry detergent compositions of the present invention typically comprise from 0% to about 15%, preferably from about 1% to about 10% by weight of such semi-polar nonionic surfactants.

Detergency builders, whether inorganic or organic, phosphatic or not, water-soluble or insoluble, and other water-soluble salts may be present, and salts of this sort may be employed whether organic detergents are present or not. A description of suitable builders is given in U.S. Pat. No. 3,936,537 and in U.S. patent application Ser. No. 589,116. Detergent builders are present from 0 to 50%, preferably from 5 to 40%.

OPTIONAL INGREDIENTS The present compositions will typically include optional ingredients that normally form part of detergent compositions. Antiredeposition and soil suspension agents, optical brighteners, bleaches, bleach activators, suds suppressors, anticacking agents, dyes and pigments are examples of such optional ingredients and can be added in varying amounts as desired.

Antiredeposition and soil suspension agents suitable herein include cellulose derivatives such as methylcellulose, carboxymethylcellulose and hydroxyethylcellulose, and homo- or co-polymeric polycarboxylic acids or their salts. Polymers of this type include the polyacrylates and maleic anhydride-acrylic acid copolymers previously mentioned as builders, as well as copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Preferred optical brighteners are anionic in character, examples of which are disodium 4,4$^1$-bis-(2-diethanolamino-4-anilino-s-triazin-6-ylamino)stilbene-2:2$^1$ disulphonate, disodium 4-4$^1$-bis-(2-morpholino-4-anilino-s-triazin-6-ylaminostilbene-2:2$^1$-disulphonate, disodium 4,4$^1$-bis-(2,4-dianilino-s-triazin-6-ylamino)stilbene-2:2$^1$-disulphonate, monosodium 4$^1$,4$^{11}$ -bis-(2,4-dianilino-s-triazin-6 ylamino)stilbene-2-sulphonate, disodium 4,4$^1$ -bis-(2-anilino-4-(N-methyl-N-2-hydroxyethylamino)-s-triazin-6-ylamino)stilbene-2,2$^1$ disulphonate, disodium 4,4$^1$-bis-(4-phenyl-2,1,3-triazol-2-yl)-stilbene-2,2$^1$ disulphonate; disodium 4,4$^1$bis(2-anilino-4-(1-methyl-2-hydroxyethylamino)-s-triazin-6-ylamino)stilbene-2,2$^1$disulphonate and sodium 2(stilbyl-4$^{11}$-(naphtho-1$^1$, 2$^1$:4,5)-1,2,3-triazole-2$^{11}$-sulphonate.

Any particulate inorganic perhydrate bleach can be used, in an amount of from 3% to 40% by weight, more preferably from 8% to 25% by weight and most preferably from 12% to 20% by weight of the compositions. Preferred examples of such bleaches are sodium perborate monohydrate and tetrahydrate, percarbonate, and mixtures thereof.

Another preferred separately mixed ingredient is a peroxy carboxylic acid bleach percursor, commonly referred to as a bleach activator, which is preferably added in a prilled or agglomerated form. Examples of suitable compounds of this type are disclosed in British Patent Nos. 1586769 and 2143231 and a method for their formation into a prilled form is described in European Published Patent Application No. 0 062 523. Preferred examples of such compounds are tetracetyl ethylene diamine and sodium 3, 5, 5 trimethyl hexanoyloxybenzene sulphonate.

Bleach activators are normally employed at levels of from 0.5% to 10% by weight, more frequently from 1% to 8% and preferably from 2% to 6% by weight of the composition.

Another optional ingredient is a suds suppressor, exemplified by silicones, and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent impermeable carrier. Alternatively the suds suppressor can be dissolved or dispersed in a liquid carrier and applied by spraying on to one or more of the other components.

As mentioned above, useful silicone suds controlling agents can comprise a mixture of an alkylated siloxane, of the type referred to hereinbefore, and solid silica. Such mixtures are prepared by affixing the silicone to the surface of the solid silica. A preferred silicone suds controlling agent is represented by a hydrophobic silanated (most preferably trimethyl-silanated) silica having a particle size in the range from 10 millimicrons to 20 millimicrons and a specific surface area above 50 $m^2/g$ intimately admixed with dimethyl silicone fluid having a molecular weight in the range from about 500 to about 200,000 at a weight ratio of silicone to silanated silica of from about 1:1 to about 1:2.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2,646,126 published Apr.28, 1977. An example of such a compound is DC-544, commercially availably from Dow Corning, which is a siloxane/glycol copolymer.

The suds suppressors described above are normally employed at levels of from 0.001% to 2% by weight of the composition, preferably from 0.01% to 1% by weight. The incorporation of the suds mofidiers is preferably made as separate particulates, and this permits the inclusion therein of other suds controlling materials such as $C_{20}$–$C_{24}$ fatty acids, microcrystalline waxes and high MW copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Soil release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4,116,885 and 4,711,730 and European Published Patent Application No. 0 272 033. A particular preferred polymer in accordance with EP-A-0 272 033 has the formula $$(CH_3(PEG)_{43})_{0.75}(POH)_{0.25}[T\text{-}PO)_{2.8}(T\text{-}PEG)_{0.4}]T\text{-}(POH)_{0.25}((PEG)_{43}CH_3)_{0.75}$$

where PEG is —$(OC_2H_4)O$—, PO is $(OC_3H_6O)$ and T is $(pcOC_6H_4CO)$.

Also very useful are modified polyesters as random copolymers of dimethyl terephtalate, dimethyl sulfoisophtalate, ethylene glycol and 1–2 propane diol, the end groups consisting primarily of sulphobenzoate and secondarily of mono esters of ethylene glycol and/or propane-diol. The target is to obtain a polymer capped at both ends by sulphobenzoate groups, "primarily", in the present context most of said copolymers herein will be endcapped by sulphobenzoate groups. However, some copolymers will be less than fully capped and therefore their end groups may consist of monoester of ethylene glycol and/or propane 1–2 diol, thereof consist "secondarily" of such species.

The selected polyesters herein contain about 46% by weight of dimethyl terephtalic acid, about 16% by weight of propane —1.2 diol, about 10% by weight ethylene glycol, about 13% by weight of dimethyl sulfobenzoic acid and about 15% by weight of sulfoisophtalic acid, and have a molecular weight of about 3.000. The polyesters and their method of preparation are described in EPA 311 342.

Certain polymeric materials such as polyvinyl pyrrolidones typically of MW 5000–20000, preferably 10000–15000, also form useful agents in preventing the transfer of labile dyestuffs between fabrics during the washing process.

A suitable chelant for inclusion in the detergent compositions in accordance with the invention is. ethylenediamine-N,N'-disuccinic acid (EDDS) or the alkali metal, alkaline earth metal, ammonium, or substituted ammonium salts thereof, or mixtures thereof. These materials are normally added to the spray dried portion of the composition, although in some instances it may be more convenient to add them as a dry mixed particulate, or spray them as a molten liquid on to other solid components of the composition.

Enzymes other than the specific peroxidase preparation herein can be present in the composition herein, such as proteases, lipases, amylases and cellulases.

The detergent compositions according to the invention can be in liquid, paste or granular forms. The enzyme may be formulated in any convenient form, e.g. as a powder or liquid. The enzyme may be stabilized in a liquid by inclusion of enzyme stabilizers. Liquid detergents may further include stabilized hydrogen peroxide precursors.

Granular compositions according to the present invention can also be in "compact form", i.e. they may have a relatively higher density than conventional granular detergents, i.e. from 550 to 950 g/l, preferably from 650 to 950g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically-comprise not more than 10% filler salt.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 75° C., especially 20° C. to 60° C. The pH of the treatment solution is preferably from 7 to 12, especially from 7 to 10.5.

The process and compositions of the invention can also be used as additive during laundry operations.

The following non-limiting examples illustrate the DTI systems and compositions of the present invention. All concentrations are expressed in gr/liter wash solution unless otherwise specified.

EXAMPLE I

PEROXIDASE WITH PHENOTHIAZINE 10-PROPIONIC ACID (PPT) IN COMBINATION WITH ANIONIC SURFACTANT

| | delta E |
|---|---|
| Matrix + LAS | 13.6 |
| Matrix + LAS + POD-system | 10.4 |
| Matrix + AS | 16.2 |
| Matrix + AS + POD-system | 3.2 |

TEST SET-UP
Miele washing machine test
Temperature: 40° C.
MATRIX:
Zeolite 2.1 gr/liter
Carbonate 0.7 gr/liter
Suds suppressor 0.07 gr/liter
Citric acid 0.15 gr/liter adjustment of pH to 9.5
POD-system:
Enzyme activity: 1 PODU/ml
PPT level: 15 μM PPT
Perborate level: 21 ppm
LAS/AS level:
0.7 gr/liter in finished product
AS is $C_{14-15}$ alkyl chain sulfate
LAS is sodium linear $C_{12}$ alkyl benzene sulphonate
Delta E value: lower=less dye transfer
Test swatches: 1 terry towel, 4000cm2 direct blue 90 on cotton. Measurements on spectraflash 500, after 1 cycle.

In conclusion, it has clearly been demonstrated that using a detergent composition without LAS viz. Matrix+AS+POD system the dye transfer is efficiently inhibited by a factor more than 3×.

PEROXIDASE WITH PHENOTHIAZINE 10-PROPIONIC ACID (PPT) IN COMBINATION WITH NONIONIC SURFACTANT

| | Delta E |
|---|---|
| Matrix + AS | 16.2 |
| Matrix + AS + POD-system | 3.2 |
| Matrix + AS + Nonionic | 21.5 |
| Matrix + AS + POD-system + Nonionic | 1.0 |

TEST SET-UP
Miele washing machine test
Temperature: 40° C.
MATRIX ::
Zeolite 2.1 gr/liter
Carbonate 0.7 gr/liter
Suds suppressor 0.07 gr/liter
Citric acid 0.15 gr/liter adjustment to pH 9.5
AS $=C_{14-15}$ alkyl sulfate: 0.7 gr/liter
POD-system:
Enzyme activity: 1PODU/ml
PPT level: 15 μM PPT
Perborate level: 21 ppm
Nonionic level:
0.7 gr/liter nonionic in wash solution For instance as nonionic surfactant is used $C_{14-15}$ alkyl 7 times ethoxylated.
Delta E value: lower=less dye transfer
Test swatches : 1 terry towel, 4000cm2 direct blue 90 on cotton. Measurements on spectraflash 500, after 1 cycle. It has been clearly demonstrated that addition of nonionic to the system (matrix+AS+POD system) even further inhibits the dye transfer with at least a factor 3×.

Reduction of dye transfer from textile to textile

4000cm$^2$ fabric dyed with Direct Blue 90 on cotton were used in these experiments. In the present experiment, washing was carried out in a Miele washing machine. The extent of dye transfer was evaluated on a terry towel that was added in the washing machine containing 1 kg polyester load. After the wash the fabrics were line dried. The Hunter color difference readings (L, a, b) were obtained for the multifibres using a Colorimeter (Spectraflash 500 manufactured by ICS). The change in the color of the fabric can be characterized by a parameter Delta E defined as Delta E=(Delta $a^2$+Delta $b^2$+Delta $L^2)^{\frac{1}{2}}$ where Delta a and Delta b and Delta L represents the difference in the intensity of reflected light between the test multifibres and a multifibre reference that was not on contact with the dyed fabrics. b represents the intensity of reflected yellow light (positive b value) or the intensity of reflected blue light (negative b value), and a is the measure of the intensity of the reflected red light (positive a value) or the reflected green light (negative a value). L is the intensity of the reflected greyness. The lower Delta E the less dye transfer.

EXAMPLE II

Compact granular detergent composition typically contains the following ingredients:

| | |
|---|---|
| Alkyl sulphate | 5% |

-continued

| | |
|---|---|
| Nonionic | 6% |
| Trisodium citrate | 15% |
| Zeolite | 32% |
| Citrate | 6% |
| Polymer | 4% |
| Chelant | 0.2% |
| Sodium sulphate | 5% |
| Sodium silicate | 2% |
| Perborate | 0.5% |
| Minors upto | 100% |

EXAMPLES III to XVIII

The following compositions are made wherein or to which the claimed composition was present/added.

a) Compact granular detergent: examples III and IV.

| EXAMPLES | III | IV |
|---|---|---|
| Tallow alkyl sulphate | 1.80 | 2.40 |
| $C_{45}$ alkyl sulphate | 14.00 | 13.10 |
| $C_{45}$ alcohol 7 times ethoxylated | 4.00 | 4.00 |
| Tallow alcohol 11 times ethoxylated | 1.80 | 1.80 |
| Dispersant | 0.07 | 0.1 |
| Silicone fluid | 0.80 | 0.80 |
| Trisodium citrate | 14.00 | 15.00 |
| Citric acid | 3.00 | 2.50 |
| Zeolite | 32.50 | 32.10 |
| Maleic acid acrylic acid copolymer | 5.00 | 5.00 |
| DETMPA | 1.00 | 0.20 |
| Alkalase | 0.60 | 0.60 |
| Lipase | 0.36 | 0.40 |
| Amylase | 0.30 | 0.30 |
| Sodium silicate | 2.00 | 2.50 |
| Sodium sulphate | 3.50 | 5.20 |
| PVP | 0.30 | 0.50 |
| Minors | up to 100 | |

b) conventional granular detergent: examples V and VI

| EXAMPLES | V | VI |
|---|---|---|
| Alkyl sulfate | 6.5 | 8.0 |
| Sodium sulfate | 15.0 | 18.0 |
| Zeolite A | 26.0 | 22.0 |
| Sodium nitrilotriacetate | 5.0 | 5.0 |
| PVP | 0.5 | 0.7 |
| TAED | 3.0 | 3.0 |
| Perborate | 15.0 | — |
| Minors | up to 100 | |

c) liquid detergent: examples VII and VIII

| EXAMPLES | VII | VIII |
|---|---|---|
| $C_{12-14}$ alkenyl succinic acid | 3.0 | 8.0 |
| Citric acid monohydrate | 10.0 | 15.0 |
| Sodium $C_{12-15}$ alkyl sulphate | 8.0 | 8.0 |
| Sodium sulfate of C12–15 alcohol 2 times ethoxylated | — | 3.0 |
| $C_{12-15}$ alcohol 7 times ethoxylated | — | 8.0 |
| $C_{12-15}$ alcohol 5 times ethoxylated | 8.0 | — |
| Diethylene triamine penta (methylene phosphonic acid) | 0.2 | — |
| Oleic acid | 1.8 | — |
| Ethanol | 4.0 | 4.0 |
| Propanediol | 2.0 | 2.0 |
| Protease | 0.2 | 0.2 |
| PVP | 1.0 | 2.0 |
| Suds suppressor | 0.15 | 0.15 |
| NaOH | up to pH 7.5 | |
| Waters and minors | up to 100 parts | |

d) granular detergent compositions: examples IX–X-III

| | IX | X | XI | XII | XIII |
|---|---|---|---|---|---|
| Alkyl sulphate | 8.0 | 20.0 | 7 | 4.5 | — |
| Alkyl ethoxysulphate | 2.0 | 6.0 | 5 | 5.5 | 9.5 |
| Mixture of $C_{25}$ and $C_{45}$ alcohol 3 and 7 times ethoxylated | 6.0 | 3.0 | 5 | — | — |
| Polyhydroxy fatty acid amide | 2.5 | — | — | — | — |
| Zeolite | 17.0 | 20.0 | 10.0 | 32.0 | 35.0 |
| Layered silicate/citrate | 16.0 | 12.5 | 10.0 | 4.0 | 0.3 |
| Carbonate | 7.0 | 23.0 | 5.0 | 10.0 | 24.0 |
| Nonanoyl Caprolactam | — | — | 5.0 | — | — |
| Maleic acid acrylic acid copolymer | 5.0 | — | 4.0 | 5.0 | 5.0 |
| Soil release polymer | 0.4 | — | 0.2 | — | — |
| Protease | 2.5 | 1.5 | 0.3 | 1.0 | 1.5 |
| Lipase | 0.2 | — | 0.3 | 0.2 | 0.2 |
| Perborate | — | 3.0 | — | 22.0 | — |
| TAED | 6.0 | — | — | 6.0 | — |
| Percarbonate | 22.0 | — | 15.0 | — | — |
| EDDS | 0.3 | — | 0.4 | — | — |
| Sud suppressor | 3.5 | 0.32 | 2.0 | 0.7 | 1.5 |
| Water, perfume and minors | up to 100 parts | | | | |

e) liquid detergent compositions: examples XIV–X-VII

| | XIV | XV | XVI | XVII |
|---|---|---|---|---|
| $C_{12}$–$C_{14}$ alkyl sulphate (sodium) | 20.0 | 12.0 | 10.0 | 11.5 |
| 2-Butyl octanoic acid | 5.0 | 7.0 | — | — |
| Sodium citrate | 1.0 | 2.5 | — | 3.0 |
| $C_{10}$ alcohol ethoxylate (3) | 13.0 | 3.5 | 25.0 | 9.5 |
| Monoethanol amine | 2.5 | 6.0 | — | — |
| Fatty acid | — | 10.0 | 14.0 | 0.1 |
| Propane diol | 8.0 | 15.0 | 8.0 | 4.5 |
| Lipase | — | 0.15 | — | 0.9 |
| Amylase | — | 0.10 | — | — |
| Protease | — | 0.50 | 1.2 | 0.5 |
| Soil release agent | — | 0.50 | — | — |
| Water/propylene glycol/ethanol | up to 100 parts | | | |

f) bar fabric cleaning compositions

A laundry bar suitable for hand-washing soiled fabrics is prepared by standard extrusion processes.

Example XVIII

| Component | Weight % |
|---|---|
| Alkyl sulfate | 30 |
| Phosphate (as sodium tripolyphosphate) | 7 |
| Sodium carbonate | 25 |
| Sodium pyrophosphate | 7 |
| Coconut monoethanolamide | 2 |
| Zeolite A (0.1–10 micron) | 5 |
| Carboxymethylcellulose | 0.2 |
| Polyacrylate (m.w. 1400) | 0.2 |
| (6-Nonanamidocaproyl)oxybenzenesulfonate | 5 |
| Sodium Percarbonate | 5 |
| Brightener, perfume | 0.2 |
| Protease | 0.3** |
| Lipase | 0.3 |
| $CaSO_4$ | 1 |
| $MgSO_4$ | 1 |
| Water | 4 |
| Filler* | Balance to 100% |

*Can be selected from convenient materials such as $CaCO_3$, talc, clay, silicates, and the like.

**Denotes mg of active enzyme per gram of composition. The detergent laundry bars are processed in conventional soap or detergent bar making equipment as commonly used in the art.

What is claimed is:

1. A detergent composition for use in a wash liquid, comprising:

a) an enzyme exhibiting peroxidase activity in an amount sufficient to yield 0.01–100 mg of enzyme per liter of wash liquid;

b) a hydrogen peroxide source selected from the group consisting of a hydrogen peroxide, hydrogen peroxide precursor, and an enzymatic system capable of generating hydrogen peroxide, wherein said hydrogen peroxide source is present in an amount sufficient to produce hydrogen peroxide in an amount of from about 0.001–5 mM;

c) an accelerator for accelerating said peroxidase activity of said enzyme wherein said accelerator is present in an amount from about 0.1 uM to about 500 uM and wherein said accelerator consists of a phenothiazine or a phenoxazine having the formula

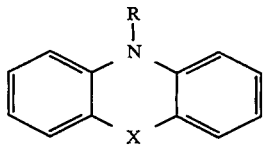

wherein X is S or O, and R is —$CH_3$, —$CH_2CH_3$, —$CH_2CH_2CH_2NH_2$ or —$CH_2CH_2COOH$; and d) from about 1 to 95 % by weight of the detergent composition of a surfactant system wherein said surfactant is selected from the group consisting of anionic, cationic, nonionic, ampholytic, zwitterionic, semi-polar agents or mixtures thereof and wherein said surfactant system is free of linear alkylbenzenesulfonate.

2. A detergent composition according to claim 1 wherein the composition comprises a peroxidase obtainable from a strain of Coprinus; wherein the peroxidase enzyme accelerator is phenothiazine 10-propionic acid; and wherein said surfactant system comprises alkylsulfate in an amount of about 10% by weight of the composition.

3. A detergent composition according to claim 2 wherein the surfactant system comprises about 10% alcohol ethoxylate.

4. A detergent composition according to claim 1 wherein the composition is a compact granular composition with a density ranging from 650–950 g/L.

5. A process for inhibiting the transfer of a textile dye, comprising the steps of:

washing or rinsing a fabric dyed with a textile dye together with a second fabric in the wash liquid, wherein the wash liquid comprises a detergent composition comprising:

a) an enzyme exhibiting peroxidase activity in an amount sufficient to yield 0.01–100 mg of enzyme per liter of wash liquid;

b) a hydrogen peroxide source selected from the group consisting of a hydrogen peroxide, hydrogen peroxide precursor, and an enzymatic system capable of generating hydrogen peroxide, wherein said hydrogen peroxide source is present in an amount sufficient to produce hydrogen peroxide in an amount of from about 0.001 –5 mM:

c) an accelerator for accelerating said peroxidase activity of said enzyme wherein said accelerator is present in an amount from about 0, 1 uM to about 500 uM and wherein said accelerator consists of a phenothiazine or a phenoxazine having the formula

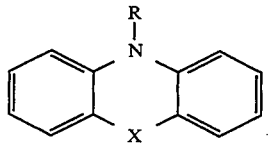

wherein X is S or O, and R is —$CH_3$, —$CH_2CH_3$, —$CH_2CH_2CH_2NH_2$ or —$CH_2CH_2COOH$; and d) from about 1 to 95% by weight of the detergent composition of a surfactant system wherein said surfactant is selected from the group consisting of anionic, cationic, nonionic, ampholyitic, zwitterionic, semi-polar agents or mixtures thereof and wherein said surfactant system is free of linear alkylbenzenesulfonate; and contacting thereby any free textile dye contained in said wash liquid with said detergent composition so as to inhibit the transfer of said textile dye to said second fabric.

6. A process for bleaching a textile dye contained in a solution or dispersion, comprising the step of: contacting said dye contained in the solution or dispersion with a detergent composition comprising;

a) an enzyme exhibiting peroxidase activity in an amount sufficient to yield 0.01–100 mg of enzyme per liter of washing liquid;

b) a hydrogen peroxide source selected from the group consisting of a hydrogen peroxide, hydrogen peroxide precursor, and an enzymatic system capable of generating hydrogen peroxide, wherein said hydrogen peroxide source is present in an amount sufficient to produce hydrogen peroxide in an amount of from about 0.001–5 mM;

c) an accelerator for accelerating said peroxidase activity of said enzyme wherein said accelerator is present in an amount from about 0.1 uM to about 500 uM and wherein said accelerator consist of a phenothiazine or a phenoxazine having the formula

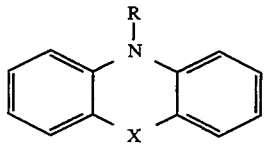

wherein X is S or O, and R is —$CH_3$, —$CH_2CH_3$—$CH_2CH_2CH_2NH_2$ or —$CH_2CH_2COOH$; and d) from about 1 to 95% by weight of the detergent composition of a surfactant system wherein said surfactant is selected from the group consisting of anionic, cationic, nonionic, ampholytic, zwitterionic, semi-polar agents or mixtures thereof and wherein said surfactant system is free of linear alkylbenzenesulfonate.

* * * * *